US008302266B2

(12) United States Patent
Chen

(10) Patent No.: US 8,302,266 B2
(45) Date of Patent: Nov. 6, 2012

(54) RESILIENT ROTATION BUCKLE

(76) Inventor: Hsi-Hsin Chen, Zhonghe (TW)

( * ) Notice: Subject to any disclaimer, the term of this patent is extended or adjusted under 35 U.S.C. 154(b) by 307 days.

(21) Appl. No.: 12/732,194

(22) Filed: Mar. 26, 2010

(65) Prior Publication Data

US 2011/0232044 A1 Sep. 29, 2011

(51) Int. Cl.
*A44B 11/00* (2006.01)
*A44B 11/22* (2006.01)
*A41F 9/00* (2006.01)

(52) U.S. Cl. ..... 24/163 K; 24/178; 16/302; 16/367; 2/301; 2/322

(58) Field of Classification Search ..... 24/163 K, 24/163 R, 170, 178, 185, 188, 191–193, 197, 24/303; 16/302, 367; 2/301, 322; *A41F 9/00; A44B 11/00*
See application file for complete search history.

(56) References Cited

U.S. PATENT DOCUMENTS

| | | | | | |
|---|---|---|---|---|---|
| 670,726 | A * | 3/1901 | Pierce | 2/322 |
| 1,383,968 | A * | 7/1921 | Perry et al. | 224/163 |
| 1,508,963 | A * | 9/1924 | Dorf | 224/163 |
| 1,525,424 | A * | 2/1925 | King | 24/265 BC |
| 1,902,981 | A * | 3/1933 | Wirth | 24/191 |
| 3,026,533 | A * | 3/1962 | Zakarin | 2/301 |
| 3,274,617 | A * | 9/1966 | Krantz | 2/301 |
| 3,855,637 | A * | 12/1974 | Luger | 2/301 |
| 4,581,791 | A * | 4/1986 | Ong | 24/163 K |
| 5,102,023 | A * | 4/1992 | Nguyen | 224/163 |
| 5,206,790 | A * | 4/1993 | Thomas et al. | 361/679.07 |
| 6,108,276 | A * | 8/2000 | Chen | 368/10 |
| 6,453,155 | B1 * | 9/2002 | Hill et al. | 455/90.1 |
| 6,941,618 | B2 * | 9/2005 | Kim | 16/337 |
| 7,055,219 | B2 * | 6/2006 | Shiba | 16/367 |
| 7,203,995 | B2 * | 4/2007 | Hsu et al. | 16/330 |
| 7,266,864 | B2 * | 9/2007 | Kim | 16/367 |
| 7,289,627 | B2 * | 10/2007 | Satoh et al. | 379/433.13 |
| 7,299,526 | B2 * | 11/2007 | Kim | 16/367 |
| 7,499,737 | B2 * | 3/2009 | Mizuta et al. | 455/575.3 |
| 7,784,655 | B2 * | 8/2010 | Su | 224/163 |
| 8,056,780 | B1 * | 11/2011 | Bruns | 224/163 |
| 2005/0150080 | A1 * | 7/2005 | Lu et al. | 16/367 |

* cited by examiner

*Primary Examiner* — Robert J Sandy
*Assistant Examiner* — Louis Mercado
(74) *Attorney, Agent, or Firm* — Leong C. Lei

(57) ABSTRACT

A resilient rotation buckle includes a decoration plate and the belt coupling structure having an end coupled to a belt. The decoration plate and the belt coupling structure form a rotation shaft and a rotation assembly that cooperate each other. The rotation assembly includes a receptacle compartment having a wall forming a through hole for receiving the rotation shaft therethrough, springs, and retention blocks. An accommodation channel is defined in the receptacle compartment in a direction normal to the through hole. When the rotation shaft is inserted, the retention blocks are in contact engagement with an outer circumference of the rotation shaft. The springs have first ends in biasing engagement with the retention blocks and second ends supported by walls of the accommodation channel. The rotation shaft and the rotation assembly allow for relative rotation therebetween for switching between a locked position and a released position.

2 Claims, 13 Drawing Sheets

RESILIENT ROTATION BUCKLE

(a) TECHNICAL FIELD OF THE INVENTION

The present invention generally relates to a belt fastening structure, and more particularly to a resilient rotation buckle.

(b) DESCRIPTION OF THE PRIOR ART

A belt buckle is often used to secure clothes and trousers and is also used for decoration purposes. Generally speaking, both the belt buckle and a belt attached to the buckle are of fixed decorations or patterns and are not good for wearing in different occasions, making them poor in use. A belt with a turn-over buckle is available in the market, having different patterns or decorations formed on opposite surfaces of the buckle or those of the belt. Thus, by turning the belt buckle over, different patterns can be switched. This meets the needs of people attending different occasions.

Chinese Patent No. 200720047277.5 discloses a dual purpose buckle having a retention plate that is capable of turning over, comprising a fixing plate, a positioning retention plate, a dual-sided turning plate. The positioning retention plate has an end that is rotatably coupled to a front end of the fixing plate through a rotation shaft. The positioning retention plate, when rotated away, forms a space with respect to the fixing plate to receive a flat belt extending therethrough. The positioning retention plate has an opposite end that is a free end. The dual-sided turning plate is mounted to the free end of the positioning retention plate with a central shaft. The positioning retention plate forms therein a cavity that has an opening. The cavity receives therein two fixing iron plates that oppose each other. Each fixing iron plate has an end connected to a spring. The end of the dual-sided turning plate that opposes the positioning retention plate is provided with a central shaft. The central shaft has opposite sides forming retention slots. The central shaft extends through the opening of the positioning retention plate and is rotatable defines a locked position and a released position. In the locked position, the two side retention slots of the central shaft and fit to the two fixing iron plates of the positioning retention plate, but the retention slots of the central shaft do not extend to the whole length of the central shaft and only correspond to the sizes of the fixing iron plates. Since in use, a user must apply a force to the turning plate in a very complicated manner, it is often that the fixing iron plates jam in the un-slotted portion of the central shaft. This affects the smooth rotation of the turning plate, causes noises, and even blocks the rotation of the turning plate. Further, forming the retention slots in the post like central shaft requires position precision of the slots. This increases the difficult of machining and also raises the costs.

SUMMARY OF THE INVENTION

In view of the above discussed problems, an objective of the present invention is to provide a resilient rotation buckle that allows for easy and smooth turn over of the buckle for switching between two surfaces thereof, that allows for easy manufacturing, and that allows for automatic turn-over positioning after the resilient rotation buckle has been rotated for a predetermined angle.

To achieve the above objective, the present invention provides a resilient rotation buckle, comprising a decoration plate and the belt coupling structure. The belt coupling structure has an end coupled to a belt. The decoration plate and the belt coupling structure form a rotation shaft and a rotation assembly that cooperate each other. The rotation assembly comprises a receptacle compartment, springs, and retention blocks. The receptacle compartment has a wall forming in a central portion thereof a through hole for receiving the rotation shaft therethrough. An accommodation channel is defined in the receptacle compartment and extends in a direction substantially normal to the through hole. When the rotation shaft is inserted, the retention blocks are in contact engagement with an outer circumference of the rotation shaft. The springs have first ends in biasing engagement with the retention blocks and second ends supported by walls of the accommodation channel. The rotation shaft and the rotation assembly allow for relative rotation therebetween for switching between a locked position and a released position. In the locked position, the retention blocks are in engagement with planar surfaces of the rotation shaft. Through the rotatable combination between the rotation shaft and the rotation assembly, the belt coupling structure and the decoration plate may define a locked position and a released position through relative rotation therebetween; and being rotated to a predetermined angular position, the rotation shaft may automatically return to the locked position.

Compared to the conventional techniques, the present invention offers the following advantages. The present invention provides a resilient rotation buckle that comprises a rotation shaft that in the form of a prism having a cross-sectional shape comprising opposite arc flanks, so as to facilitate the turn over operation of the resilient rotation buckle, allow the resilient rotation buckle to automatically complete the turn over operation by only rotating the buckle to a predetermined angle, eliminate noise caused thereby, and simplify the machining process thereof.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
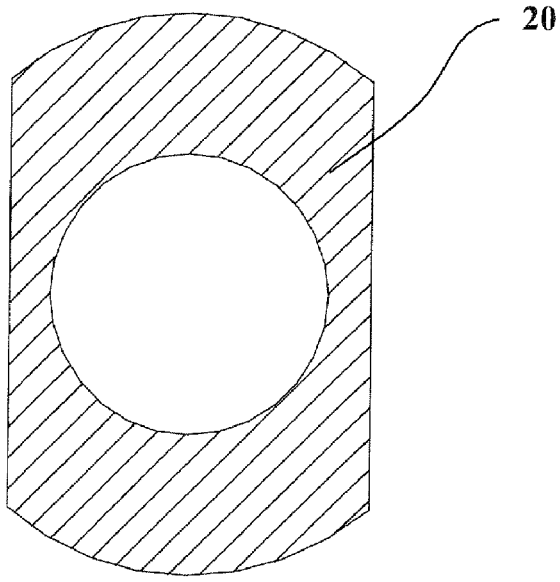
FIG. 1 is a cross-sectional view of a rotation shaft according to the present invention.
Figure 2:
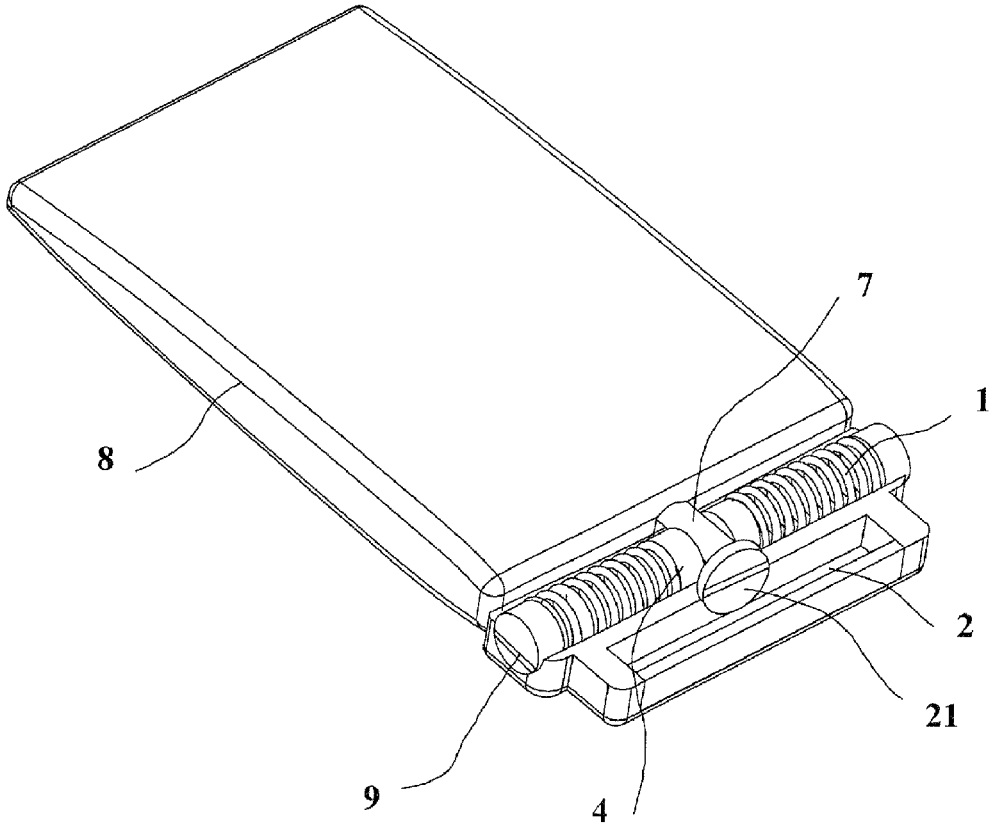
FIG. 2 is a perspective view of a rotatable combination of the rotation shaft and a rotation assembly of the resilient rotation buckle of the present invention.
Figure 3:
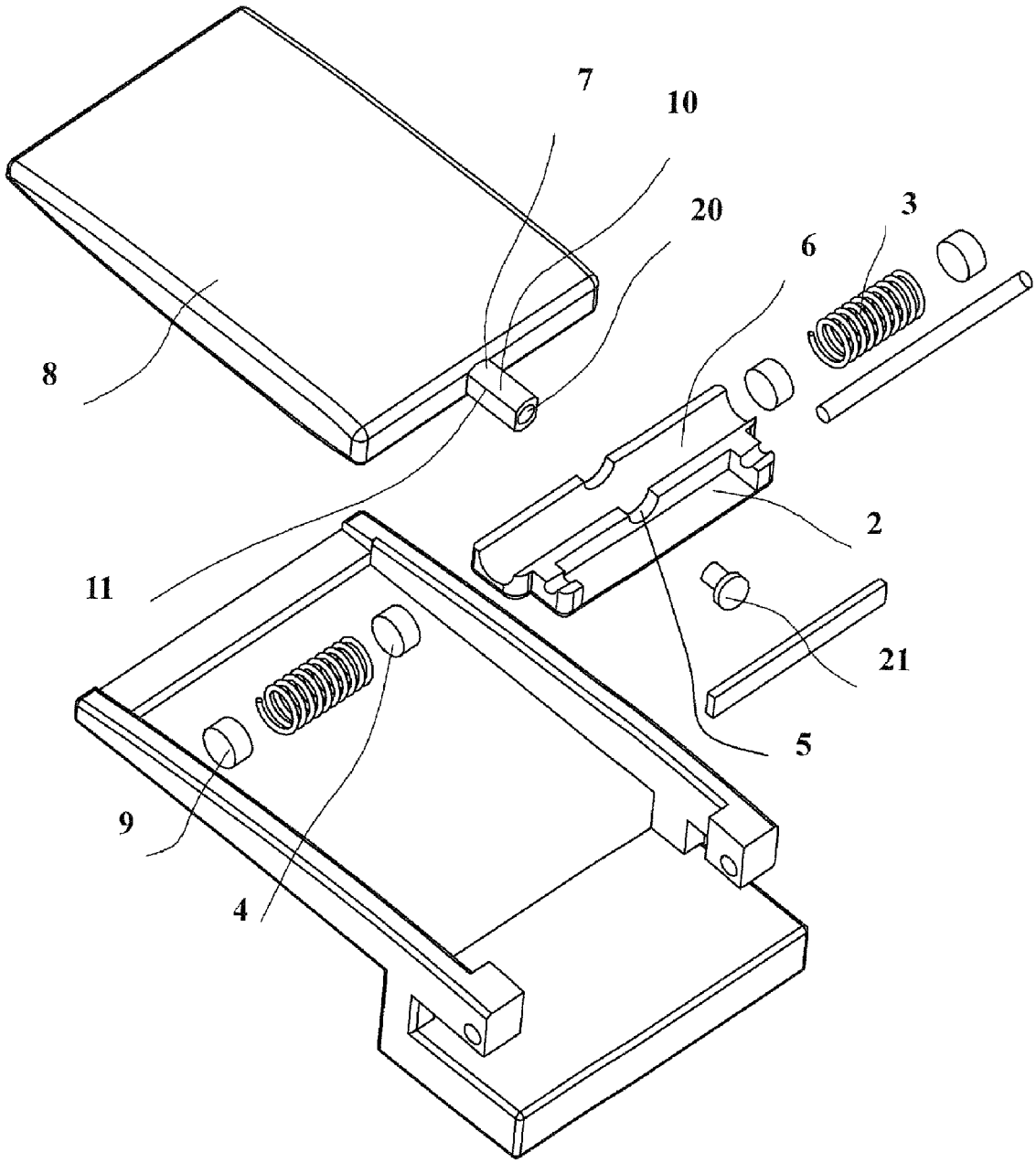
FIG. 3 is an exploded view of the present invention.

A detailed description of the present invention will be given with reference to the attached drawings, particularly FIGS. 1, 2, and 3, which respectively show a cross-sectional view of a rotation shaft of a resilient rotation buckle according to the present invention, a perspective view of a rotatable combination of the rotation shaft and a rotation assembly of the buckle of the present invention, and an exploded view of the resilient rotation buckle of the present invention, the rotation shaft, which is designated with reference numeral 7, is fixed to a decoration plate 8 or a belt coupling structure and comprises two arc side surfaces 10 and two planar side surfaces 11. In other words, the rotation shaft 7 is in the form of a prism having a cross-sectional shape of arc flanks (as shown in FIG. 1). Each arc surface of the cross-section of the rotation shaft 7 has a central angle of approximately 0-180 degrees and preferably 80 degrees. The rotation shaft 7 has a free end having an end face in which an inner-threaded hole 20 is defined. The rotation assembly, generally designated with reference numeral 1, comprises a receptacle compartment 2, two springs 3, and two retention blocks 4. The receptacle compartment 2 has a wall in which a through hole 5 is defined for receiving the rotation shaft 7 therethrough. An accommodation channel 6 is defined in the receptacle compartment 2, preferably in the wall thereof, and extending in a direction substantially normal to the through hole 5. With the rotation shaft 7 inserted into the rotation assembly 1 via the through hole 5, the retention blocks 4 are set in contact engagement with the arc surfaces 10 or the planar surfaces 11 on the outer circumference of the rotation shaft 7 with inner ends of the springs 3 in biasing engagement with the retention blocks 4 and outer ends supported by walls of the accommodation channel or fixing bolts 9. The rotation shaft 7 and the rotation assembly 1 are allow doing relative rotation with respect to each other to switch between a locked position and a released position. FIG. 2 shows the locked position, where the retention blocks 4 are forced against the two planar surfaces 11 of the rotation shaft 7. The inner-threaded hole 20 defined in the free end face of the rotation shaft 7 is engageable with a bolt 21 to couple the rotation assembly 1 and the rotation shaft 7 together in a relatively rotatable manner. A cover is provided at an outer side of the receptacle compartment 2 to close the receptacle compartment for aesthetic purposes.

Figure 4:
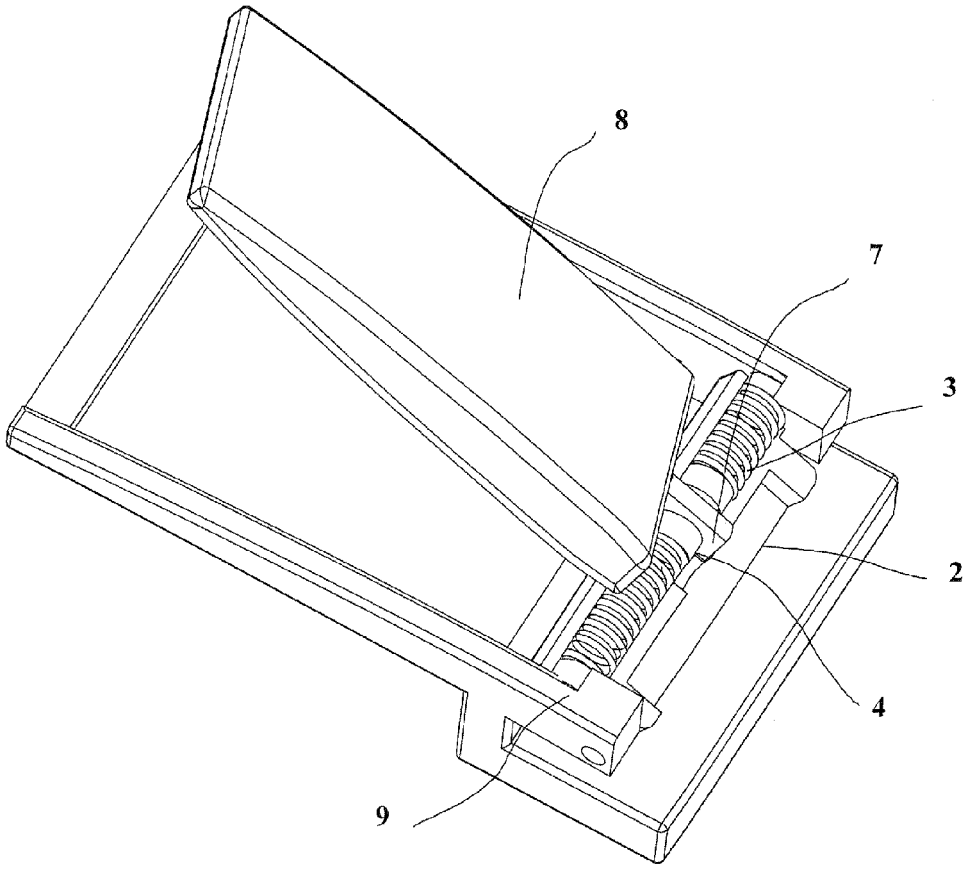
FIG. 4 shows the spatial relationship between the rotation shaft and the rotation assembly during the operation thereof.
Figure 5:
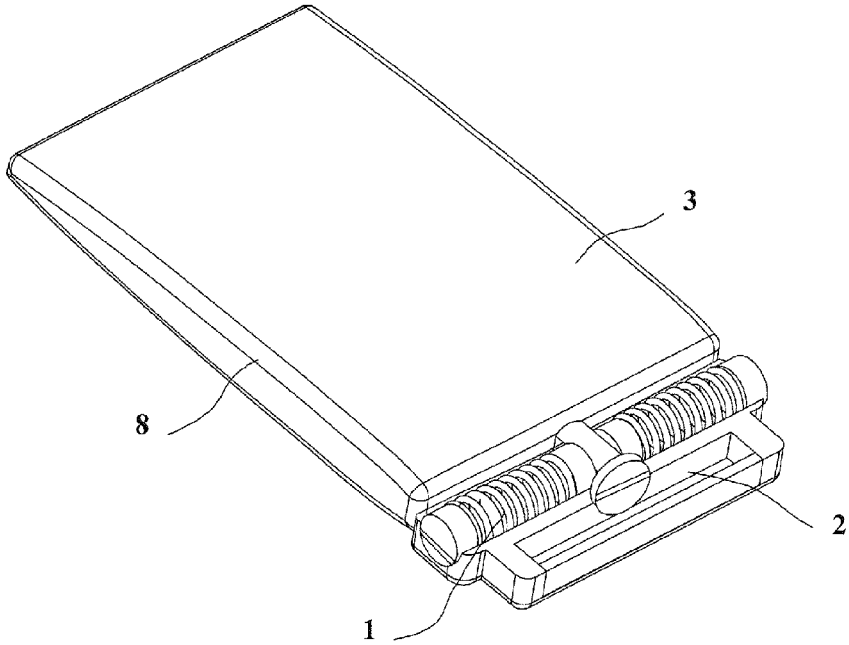
FIG. 5 is schematic view showing the rotation shaft and the rotation assembly in a condition before rotation.
Figure 6:
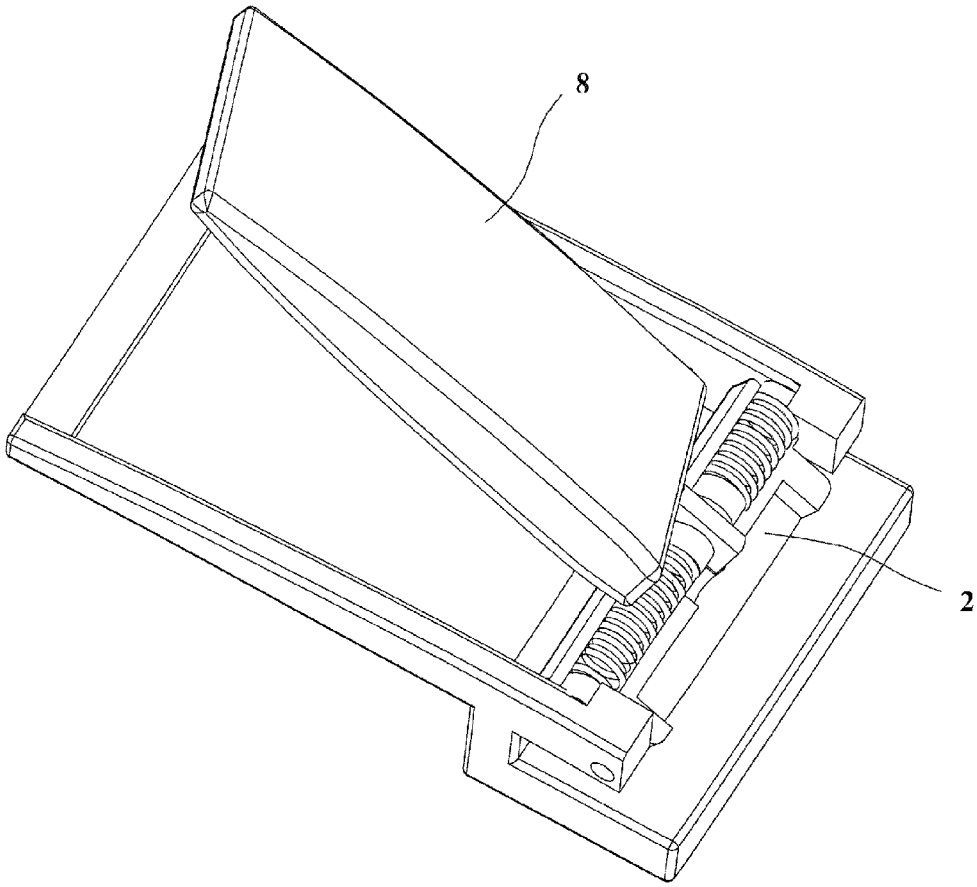
FIG. 6 is a schematic view showing the resilient rotation buckle of the present invention in a condition after clockwise rotation of a small angle.
Figure 7:
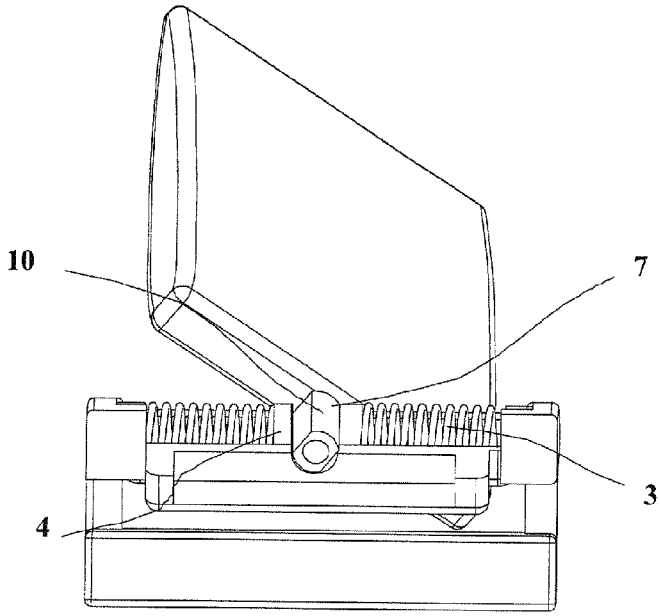
FIG. 7 is a right elevational view of FIG. 6.
Figure 8:
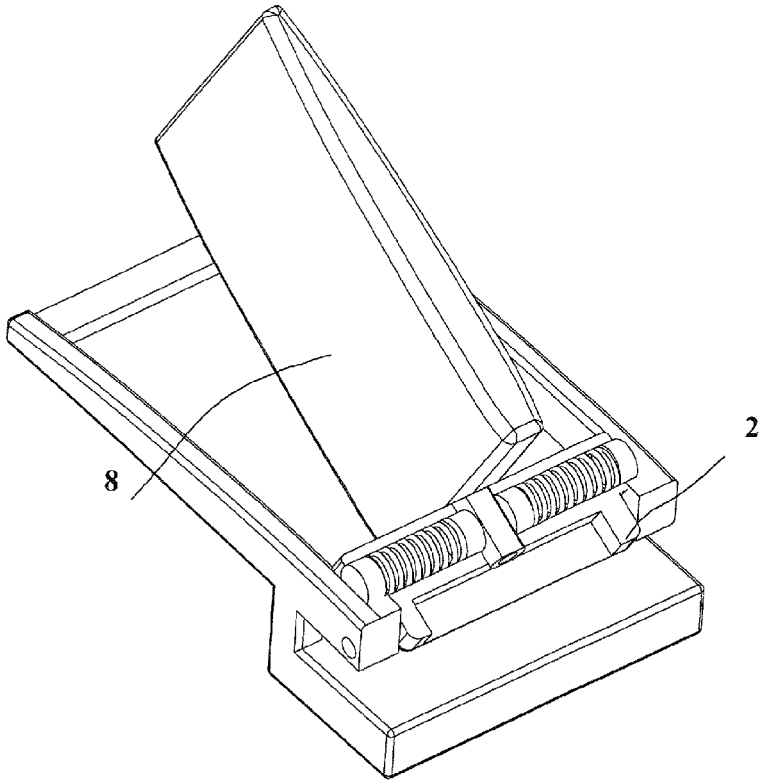
FIG. 8 is a schematic view showing the resilient rotation buckle of the present invention in a condition after clockwise rotation of 90 degrees.
Figure 9:
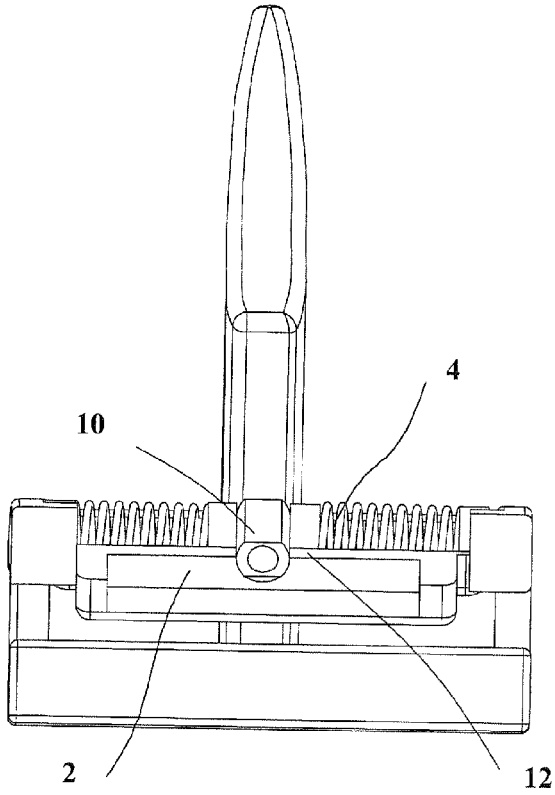
FIG. 9 is a right elevational view of FIG. 8.
Figure 10:
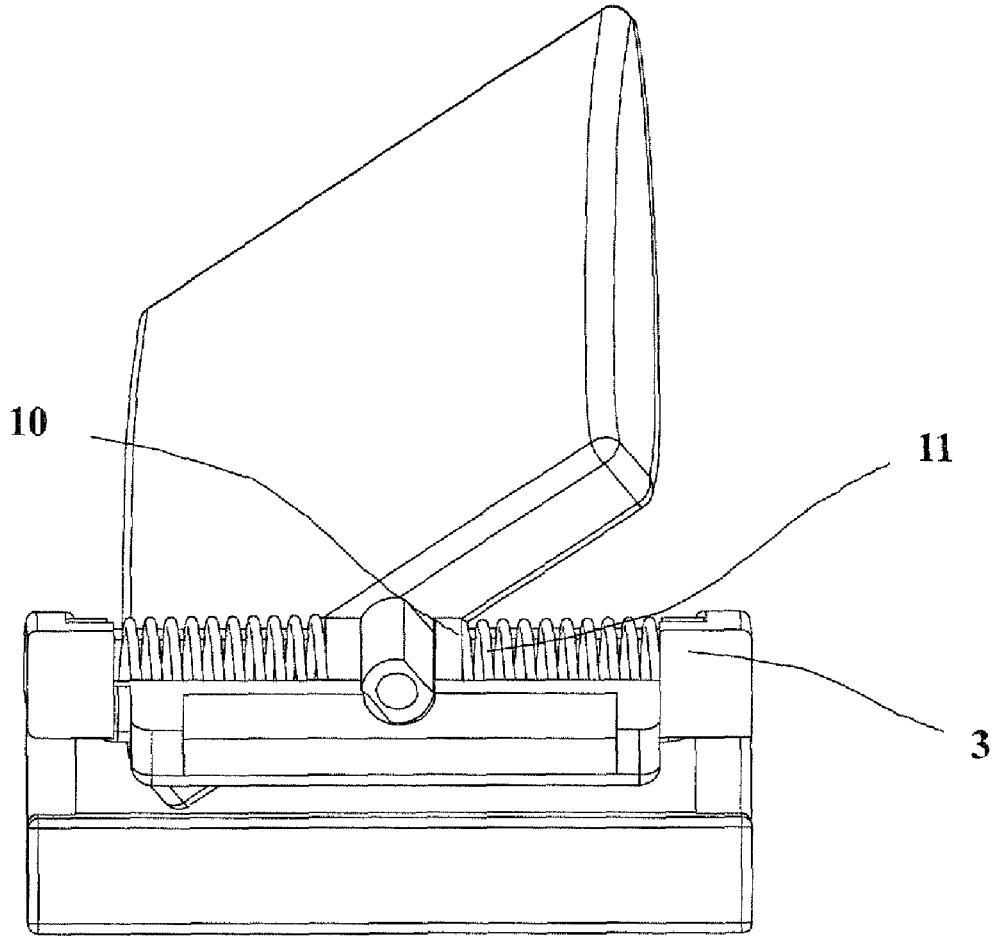
FIG. 10 shows the resilient rotation buckle of the present invention in a condition of being clockwise rotated to a critical position.

FIG. 4 shows the spatial relationship between the rotation shaft and the rotation assembly during the operation thereof. Here, clockwise or counterclockwise rotation can be performed between the rotation shaft and the rotation assembly. FIGS. 5-10 show the operation of rotation of the resilient rotation buckle according to the present invention. FIG. 5 shows the rotation shaft 7 and the rotation assembly 1 are in the locked condition. Under this condition, the two springs 3 show the minimum spring forces. By rotating the decoration plate 8 in for example clockwise direction, the spring forces generated by the springs 3 are increasing. As shown in FIG. 6, after rotation of a given angle, of which FIG. 7 is a right elevational view, from which it is observed that the given angle is less than 90 degrees and the retention blocks 4 are in contact with the arc surfaces 10 of the rotation shaft 7. Further rotation to reach the position shown in FIG. 8, of which FIG. 9 is a right elevational view, it is observed that the retention blocks 4 are now in contact with the highest apexes 12 of the arc surfaces 10 and with further rotation, the retention blocks 4 reach the position shown in FIG. 12, namely the junctions between the planar surfaces 11 and the arc surfaces 10, where a slight force applied in the clockwise direction will cause the decoration plate 8 to pass the position and then the decoration plate 8 will be driven by the spring forces of the springs 3 to return the locked position shown in FIG. 5, automatically finishing positioning of the rotation shaft. It is noted here that besides FIG. 5 showing the locked position, all other relative position between the rotation shaft 7 and the rotation assembly 1 are considered released positions.

Figure 11:
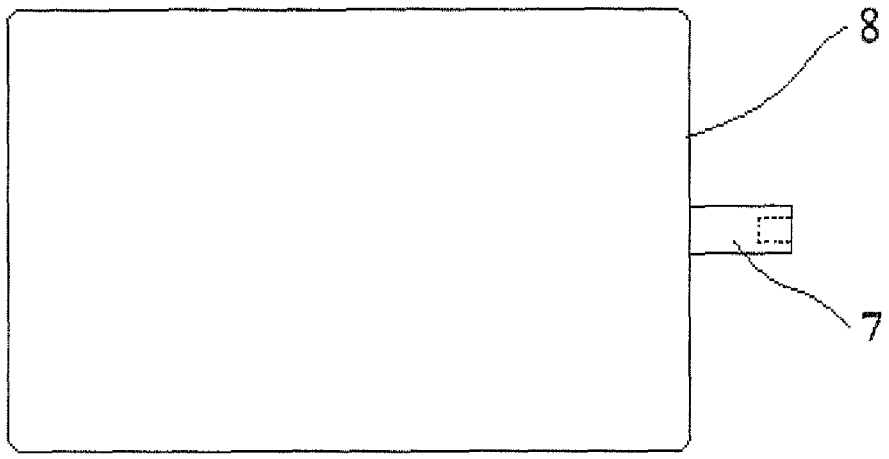
FIG. 11 is a top plan view of a decoration plate of the resilient rotation buckle of the present invention.
Figure 12:
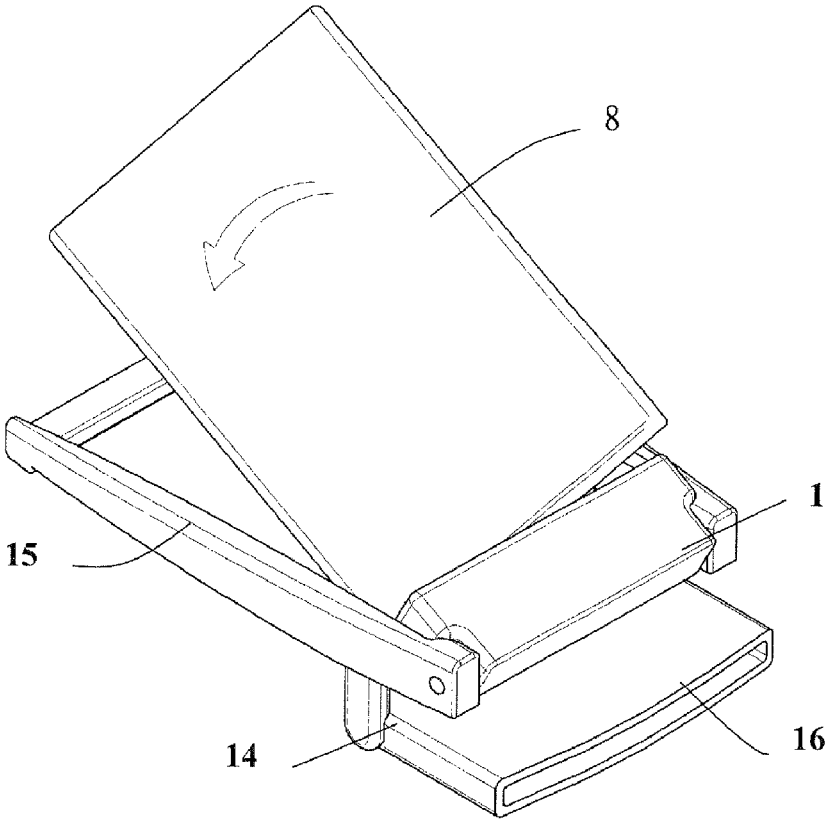
FIG. 12 is a perspective view showing a resilient rotation buckle according to the present invention.

FIGS. 11 and 12 show a first embodiment of the present invention, wherein the resilient rotation buckle of the present invention comprises a decoration plate 8, a belt coupling structure 14, a rotation shaft 7, and a rotation assembly 1. The belt coupling structure 14 comprises a hollow frame 15 and a belt clamping structure 16 that is formed on a lower side of the frame 15 for clamping and fixing a belt. The rotation assembly 1 is pivotally connected to the frame 15 at an end close to the belt by a pivot pin that is substantially parallel to an upper surface of the frame 15. In normal use, the decoration plate 8 has an end that is coupled to the rotation assembly 1 by the rotation shaft 7 attached thereto (as shown in FIG. 11) and an opposite end that is free and positioned on the frame 15. To turn the decoration plate 8 over the free end of the decoration plate 8 is lifted upward by rotation about the pivot pin by a predetermined angle so as to turn the rotation assembly 1 upwards to the predetermined angle. Afterwards, the decoration plate 8 is rotated about the rotation shaft 7, either clockwise or counterclockwise, to an angular displacement of approximately 130 degrees where the decoration plate 8, under the action of the spring forces of the springs 3, automatically returns to the locked position shown in FIG. 5, where the retention blocks 4 are set on the planar surfaces of the rotation shaft 7 to complete the process of automatic positioning for turn over of the resilient rotation buckle, by which turn over of the decoration plate is done. The free end of the decoration plate 8 may now be positioned back to the frame 15.

Figure 13:
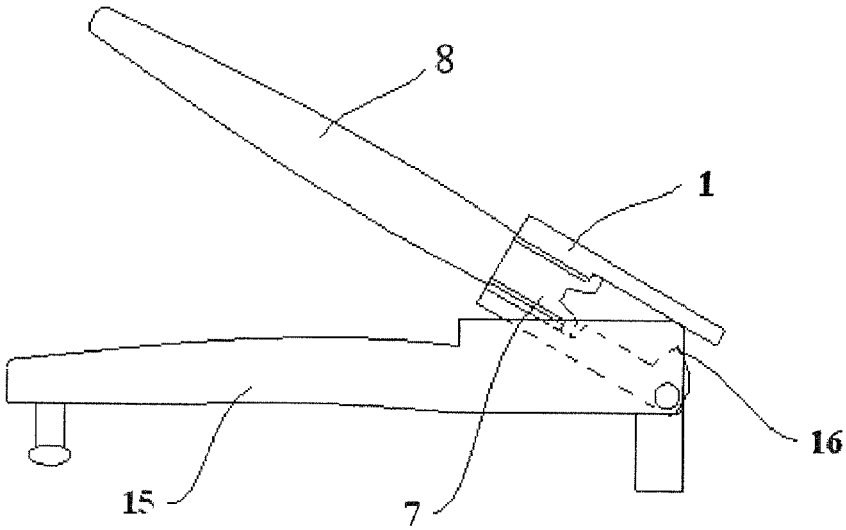
FIG. 13 is a front view of a resilient rotation buckle of another structure according to the present invention.

FIG. 13 shows a second embodiment of the present invention, which is similar to the previously discussed first embodiment with a modification being made that the belt clamping structure 16 is pivotally connected to an end of the frame 15 and the rotation assembly 1 is set on a free end of the belt clamping structure 16. Again, in normal use, the free end of the decoration plate 8 is positioned on the frame 15. When it is desired to turn the decoration plate 8 over, the free end of the decoration plate 8 is lifted upward by rotation about the pivotal connection to turn the rotation assembly 1 and the belt clamping structure 16 upward to a predetermined angle. Afterward, rotation of the decoration plate 8 about the rotation shaft 7 is carried out in either the clockwise direction or the counterclockwise direction to an angle of approximately 130 degrees, where the decoration plate 8, under the action of the spring forces of the springs 3, automatically returns to the locked position shown in FIG. 5, where the retention blocks 4 are set on the planar surfaces of the rotation shaft 7 to complete the process of automatic positioning for turn over of the resilient rotation buckle, by which turn over of the decoration plate 8 is done. The free end of the decoration plate 8 may now be positioned back to the frame 15.

Figure 14:
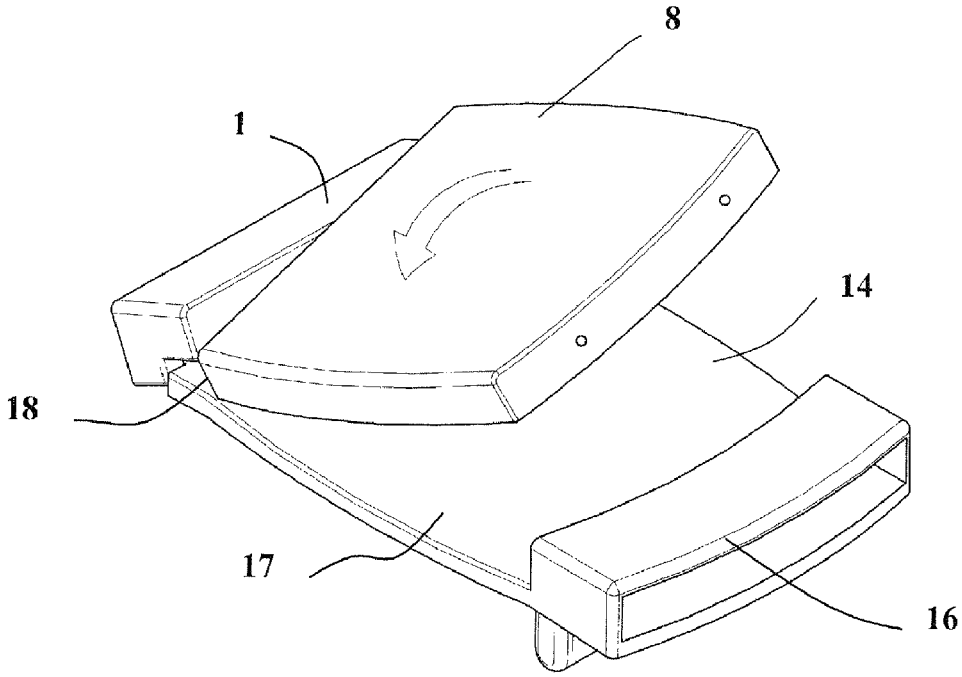
FIG. 14 is a perspective view of a resilient rotation buckle of a further structure according to the present invention.

FIG. 14 shows a third embodiment of the present invention, of which the resilient rotation buckle according to the present invention comprises a decoration plate 8, a belt coupling structure 14, a rotation shaft 7, and a rotation assembly 1. The belt coupling structure 14 comprises a support base 17 that functions to support the decoration plate 8 thereon and has a buckling end 18 to which the rotation assembly 1 is pivotally connected and an opposite end forming a belt clamping structure 16 for clamping a belt. The decoration plate 8 has an end forming the rotation shaft 7 and an opposite end forming a locking structure that is engageable with the belt clamping structure 16. The decoration plate 8 is rotatably coupled to the rotation assembly 1 through the rotation shaft 7. In normal use, the decoration plate 8 is set on the support base 17. When it is desired to turn the decoration plate 8 over, the free end of the decoration plate 8 is lifted upward by rotation about the pivotal connection to turn the rotation assembly 1 upward to a predetermined angle. Afterward, rotation of the decoration plate 8 about the rotation shaft 7 is carried out in either the clockwise direction or the counterclockwise direction to an angle of approximately 130 degrees, where the decoration plate 8, under the action of the spring forces of the springs 3, automatically returns to the locked position shown in FIG. 5, where the retention blocks 4 are set on the planar surfaces of the rotation shaft 7 to complete the process of automatic positioning for turn over of the resilient rotation buckle, by which turn over of the decoration plate is done. The free end of the decoration plate 8 may now be positioned back to the support base 17 and locked to the belt clamping structure 16.

Figure 15:
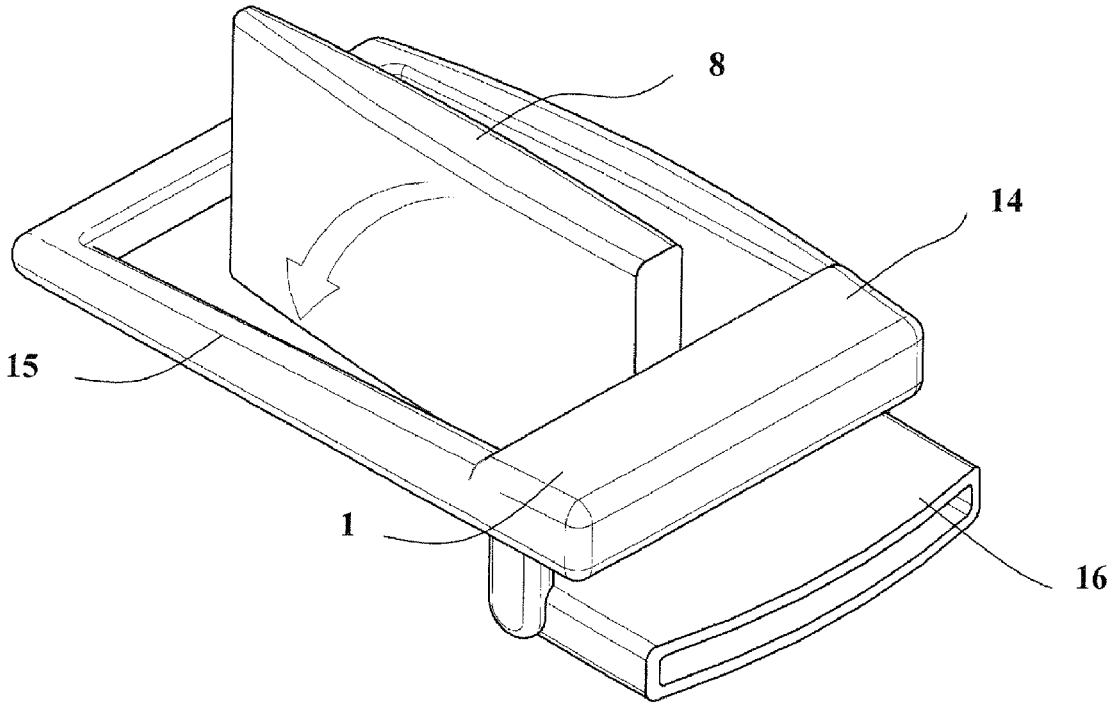
FIG. 15 is a perspective view of a resilient rotation buckle of a further structure according to the present invention.

FIG. 15 shows a fourth embodiment of the present invention, of which the resilient rotation buckle according to the present invention comprises a decoration plate 8, a belt coupling structure 14, a rotation shaft 7, and a rotation assembly 1. The belt coupling structure 14 comprises a hollow frame 15 having an end forming on a bottom thereof a belt clamping structure 16. The rotation assembly 1 is also mounted to the end of the frame 15. The decoration plate 8 has an end forming the rotation shaft 7 and the decoration plate 8 is rotatably coupled to the rotation assembly 1 through the rotation shaft 7 for being positioned in the frame 15. When it is desired to turn the decoration plate 8 over, the decoration plate 8 is rotated about the rotation shaft 7 in either the clockwise direction or the counterclockwise direction to an angle of approximately 130 degrees, where the decoration plate 8, under the action of the spring forces of the springs 3, automatically returns to the locked position shown in FIG. 5, where the retention blocks 4 are set on the planar surfaces of the rotation shaft 7 to complete the process of automatic positioning for turn over of the resilient rotation buckle, by which turn over of the decoration plate 8 is done. In this embodiment, there is no need to lifting upward of the free end of the decoration plate 8 is rotating the decoration plate 8, and instead, the decoration plate 8 is directly rotated inside the frame 15, making the operation easy and simplified.

Figure 16:
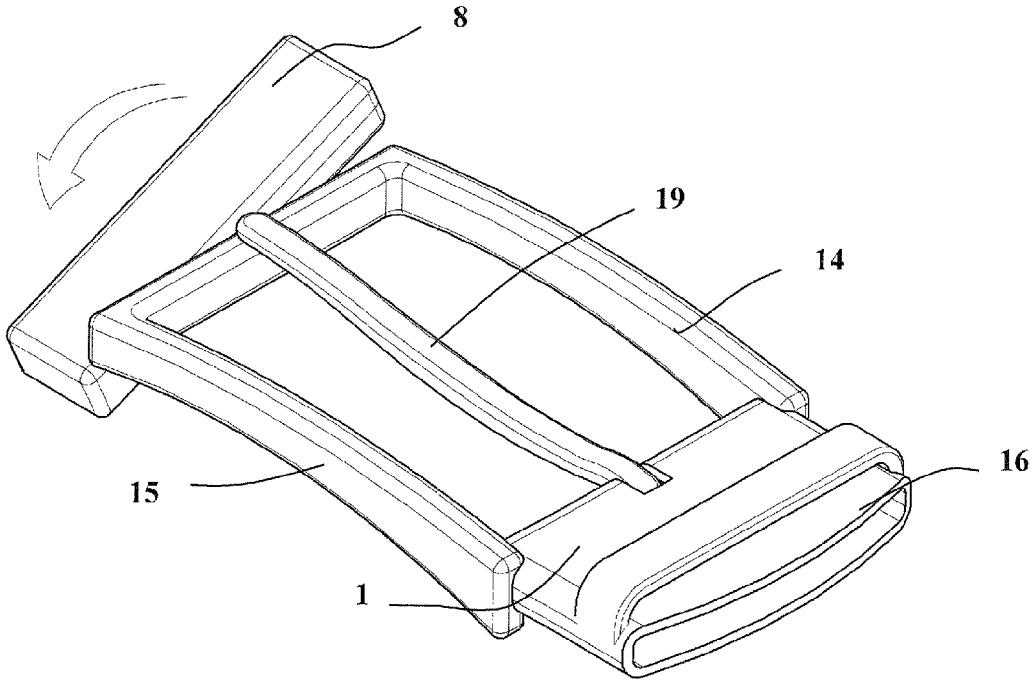
FIG. 16 is a perspective view of a resilient rotation buckle of yet a further structure according to the present invention.
Figure 17:
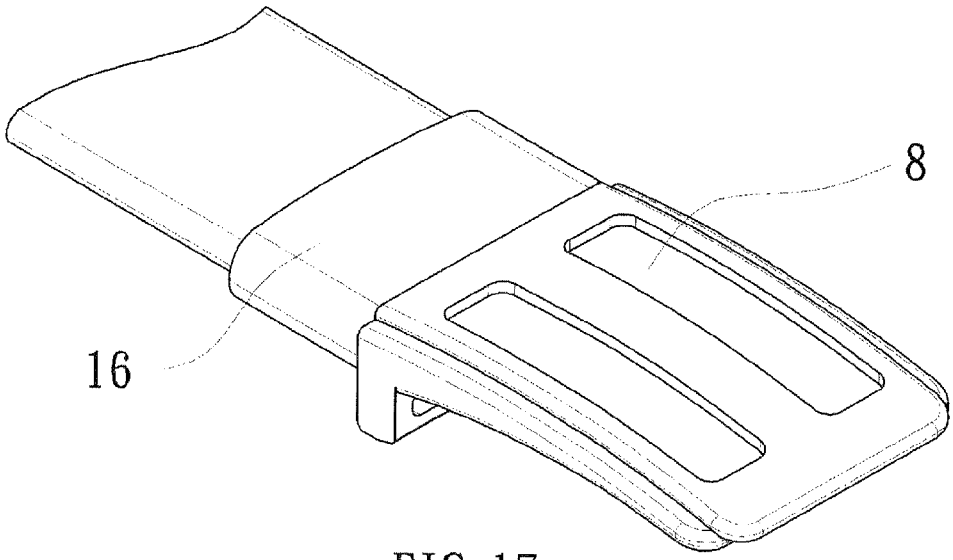
FIG. 17 is a schematic view of a resilient rotation buckle of a further inside structure according to the present invention.
Figure 18:
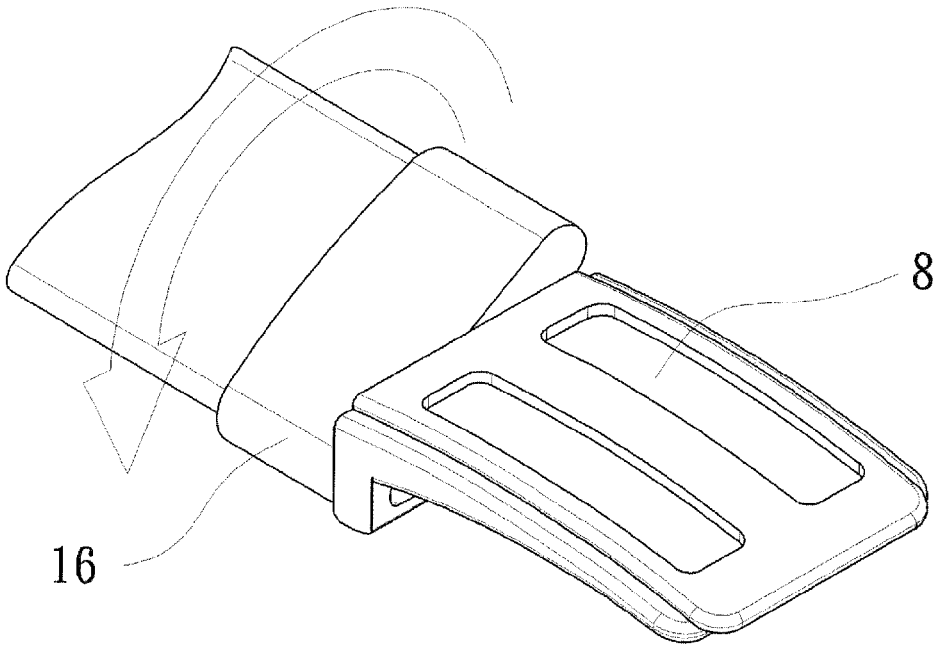
FIG. 18 is a schematic view of a resilient rotation buckle of a further inside structure according to the present invention.

FIG. 16 shows a fifth embodiment of the present invention, of which the resilient rotation buckle according to the present invention comprises a decoration plate 8, a belt coupling structure 14, a rotation shaft 7, and a rotation assembly 1. The belt coupling structure 14 comprises a hollow frame 15 having an end forming a belt clamping structure 16 for clamping and fixing a belt. The end of the frame 16 that is adjacent to the belt carries a prong 19. The frame 15 has an opposite end forming the rotation shaft 7. The rotation assembly 1 is received in a decoration plate 8 and is rotatably and externally coupled to the frame 15 by the rotation assembly 1, whereby the frame 15 and the decoration plate 8 are located on the same plane when in a locked position. When it is desired to turn the decoration plate 8 over, the decoration plate 8 is rotated about the rotation shaft 7 in either the clockwise direction or the counterclockwise direction to an angle of approximately 130 degrees, where the decoration plate 8, under the action of the spring forces of the springs 3, automatically returns to the locked position shown in FIG. 5, where the retention blocks 4 are set on the planar surfaces of the rotation shaft 7 to complete the process of automatic positioning for turn over of the resilient rotation buckle, by which turn over of the decoration plate 8 is done. The operation is easy and simple FIGS. 17 and 18 shows a sixth embodiment of the present invention, of which the resilient rotation buckle comprises a decoration plate 8 and a belt clamping structure 16 that is rotatably mounted to the decoration plate 8. The belt clamping structure 16 receives a rotation assembly and curved spring plates or a spring clip received therein to correspond to a rotation shaft. Thus, by rotating the belt clamping structure 16 in either the clockwise direction or the counterclockwise direction to an angle of approximately 130 degrees, the belt clamping structure 16 is acted upon by the spring forces of the rotation assembly and the curved spring plates or the spring clip to automatically return to the position shown in FIG. 17, where the belt clamping structure 16 is substantially parallel to the decoration plate 8 to complete the process of automatic positioning for turn over.

Figure 19:
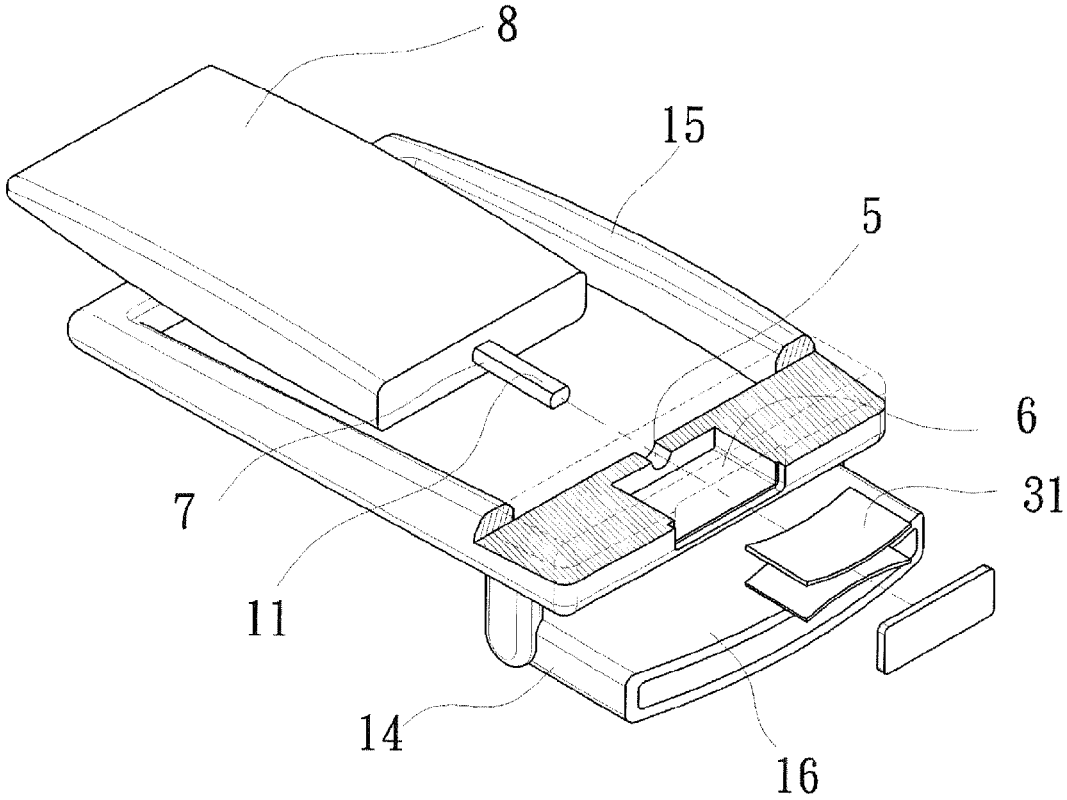
FIG. 19 is a schematic view of a resilient rotation buckle of a further inside structure according to the present invention.
Figure 20:
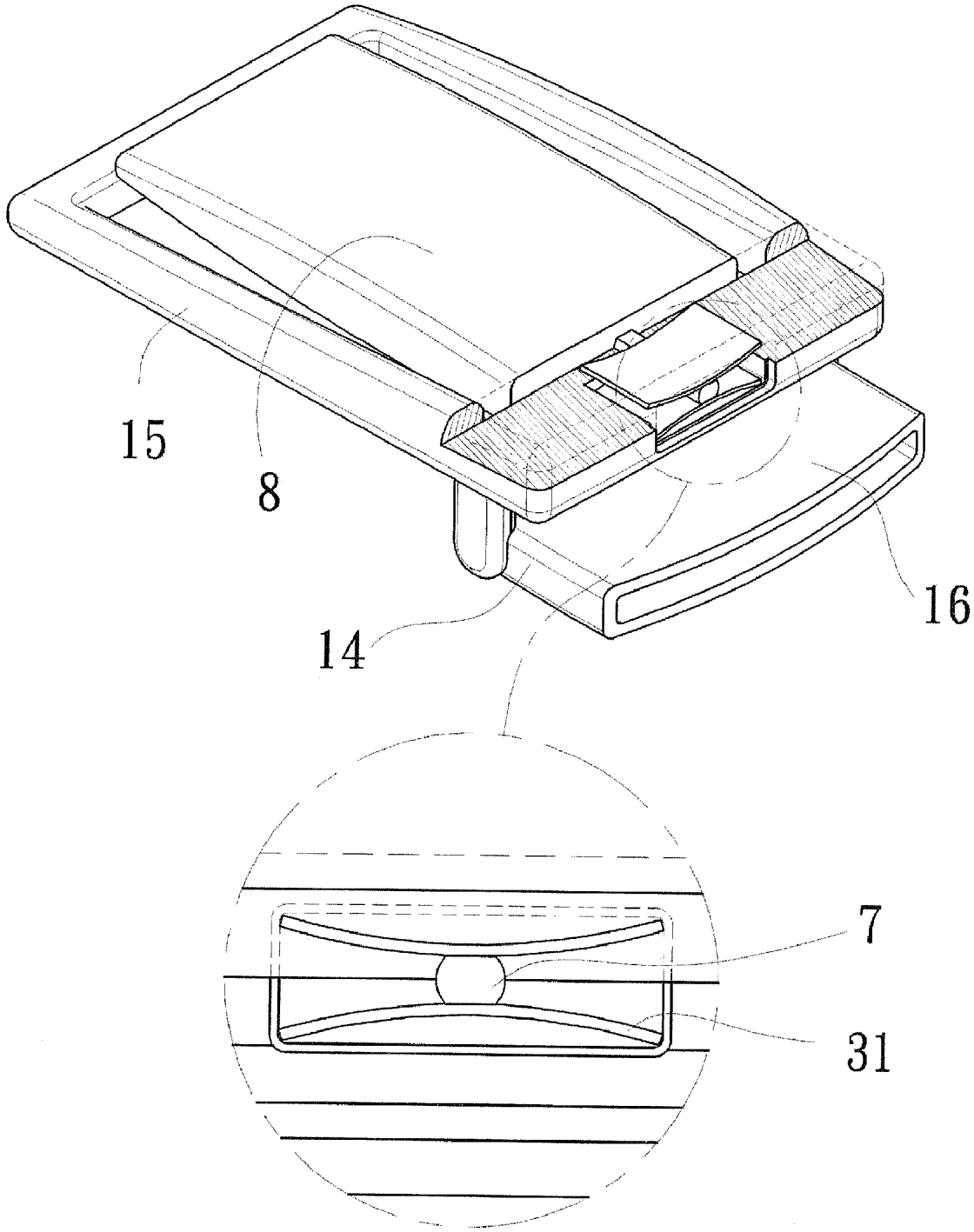
FIG. 20 is a schematic view of a resilient rotation buckle of a further inside structure according to the present invention.
Figure 21:
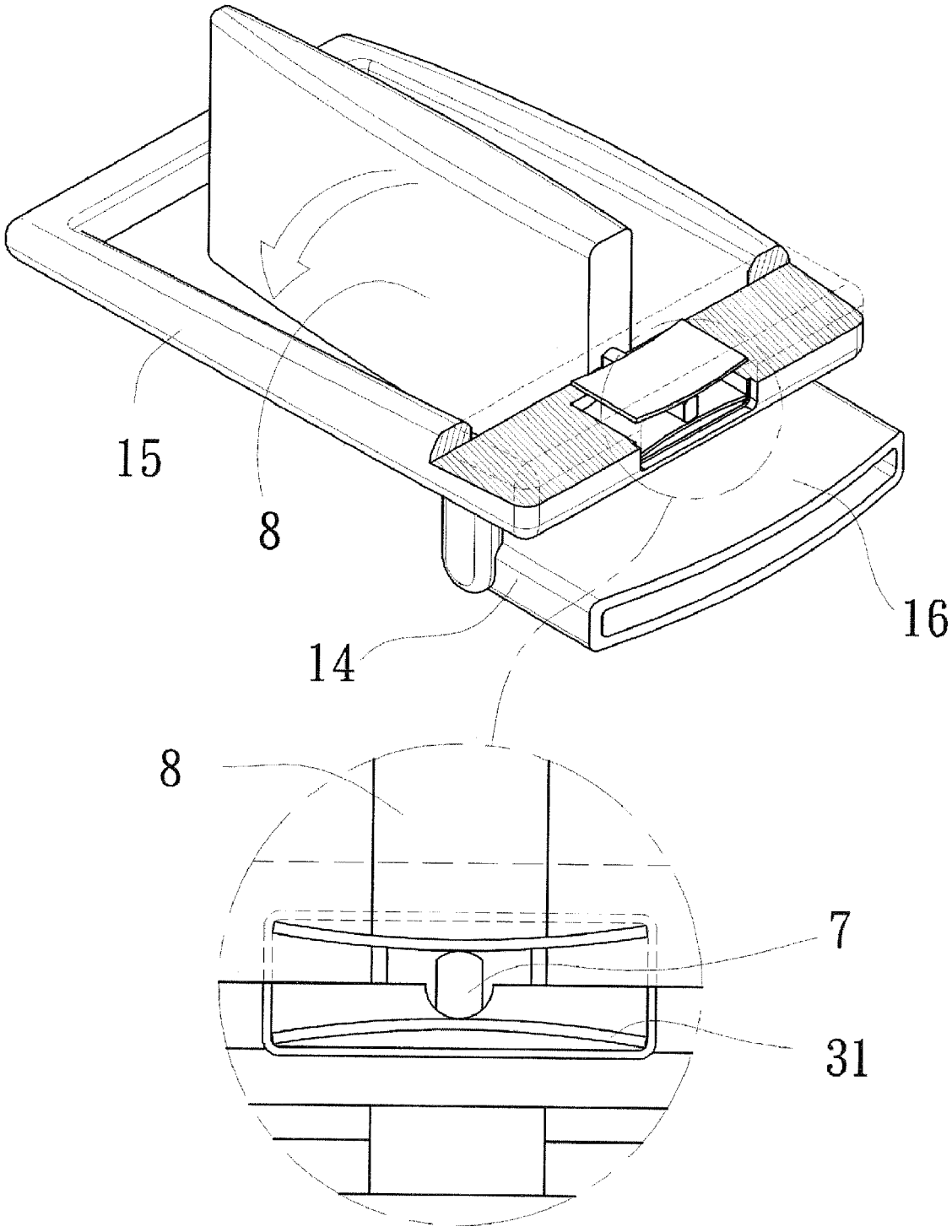
FIG. 21 is a schematic view of a resilient rotation buckle of a further inside structure according to the present invention.

FIGS. 19, 20, and 21 show a seventh embodiment of the present invention, of which the resilient rotation buckle according to the present invention comprises a decoration plate 8, a belt coupling structure 14, and a rotation shaft 7. The belt coupling structure 14 comprises a hollow frame 15 having an end forming on a bottom thereof a belt clamping structure 16. When the decoration plate 8 is in a parallel condition, curved spring plates 31 are in tight engagement with planar surfaces 11 of the rotation shaft 7, and under this condition, the curved spring plates 31 show the maximum curvature inside an accommodation channel 6 and smallest spring forces. As shown in FIG. 19, when the decoration plate 8 is gradually rotated, the rotation shaft 7 changes angular position, making the curved spring plates 31 that are in contact with the rotation shaft 7 increasing the spring forces thereof. Thus, when the decoration plate 8 is rotated by approximately 130 degrees, the curved spring plates 31 drive the rotation of the rotation shaft 7 to cause automatic rotation of the decoration plate 8 back to the parallel condition thereby completing automatic positioning after the rotation.

Figure 22:
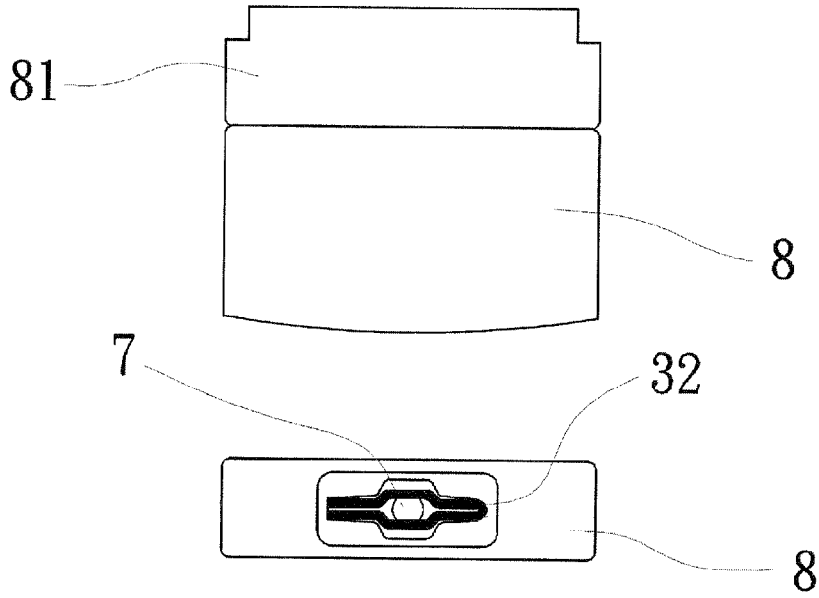
FIG. 22 is a schematic view of a resilient rotation buckle of a further inside structure according to the present invention.
Figure 23:
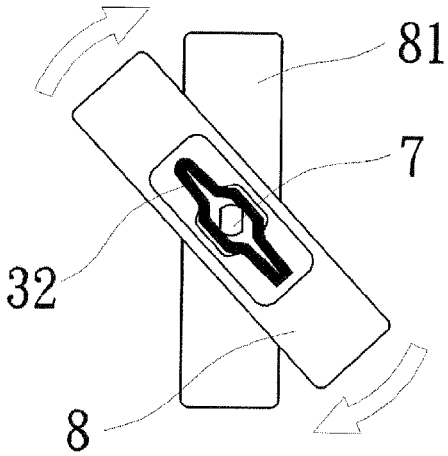
FIG. 23 is a schematic view of a resilient rotation buckle of a further inside structure according to the present invention.
Figure 24:
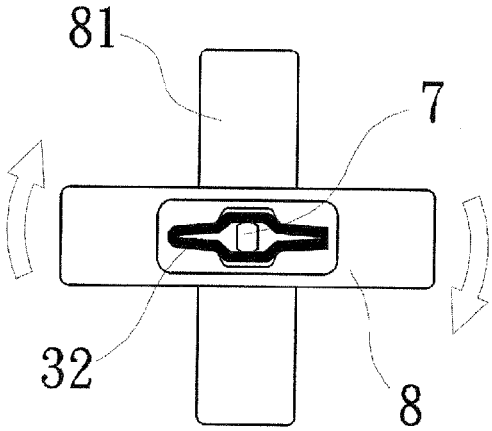
FIG. 24 is a schematic view of a resilient rotation buckle of a further inside structure according to the present invention.

FIGS. 22, 23, and 24 show an eighth embodiment of the present invention, wherein a rotation shaft 7 is mounted to a fixing piece 81. A spring clip 32 is received inside a decoration plate 8. When the decoration plate 8 is rotated to be parallel to planar surfaces of the rotation shaft 7, the spring clip 32 is in tight engagement with the planar surfaces of the rotation shaft 7. Under this condition, the overall width of the spring clip 32 inside an accommodation channel is the minimum. When the decoration plate 8 is gradually rotated, the spring clip 32 is caused to rotate, making the spring clip 32 that is in contact engagement with the rotation shaft 7 outward expanded and increasing the spring force thereof. Thus, when the decoration plate 8 is rotated by approximately 130 degrees, the spring force of the spring clip 32 drives the rotation of the decoration plate 8 to realize automatic positioning after the rotation.

Other variations of the resilient rotation buckle of the present invention can be contemplated without departing the scope of the present invention. For example, the decoration plate can be of a two-side decoration structure carrying identical or different patterns.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A resilient rotation buckle comprising:

a belt coupling structure having a hollow frame and an accommodation channel which is in communication with said hollow frame via a through hole, said hollow frame having an end provided at a bottom thereof with a belt clamping structure;

a decoration plate fitted in said hollow frame;

a rotation shaft having a first end fixed to said decoration plate and a second end extending through said through hole into said accommodation channel, said rotation shaft having two opposite arc side surfaces and two opposite planar side surfaces; and a pair of curved spring plates fitted in said accommodation channel and being in tight engagement with said planar side surfaces of said rotation shaft;

wherein when said decoration plate is in a parallel condition, said curved spring plates are in tight engagement with said planar surfaces of said rotation shaft thereby causing said curved spring plates to show maximum curvature inside said accommodation channel and smallest spring forces; when said decoration plate is gradually rotated, said rotation shaft changes angular position thus making said curved spring plates that are in contact with said rotation shaft to increase spring forces thereof; and when said decoration plate is rotated by 130 degrees, said curved spring plates will drive rotation of said rotation shaft hence causing automatic rotation of said decoration plate back to said parallel condition and therefore completing automatic positioning after said rotation.

2. A resilient rotation buckle comprising:

a fixing piece;

a decoration plate arranged adjacent to said fixing piece and having an accommodation channel;

a rotation shaft having a first end fixed to said fixing piece and a second end extending through said decoration plate, said rotation shaft having two opposite arc side surfaces and two opposite planar side surfaces; and a spring clip received inside said accommodation channel of said decoration plate and being in tight engagement with said planar side surfaces of said rotation shaft;

wherein when said decoration plate is rotated to be parallel to said planar surfaces of said rotation shaft, said spring clip is in tight engagement with said planar surfaces of said rotation shaft and overall width of said spring clip inside said accommodation channel is minimum; when said decoration plate; when said decoration plate is gradually rotated, said spring clip is caused to rotate, making said spring clip that is in contact engagement with said rotation shaft outward expanded and increasing spring force thereof; and when said decoration plate is rotated by 130 degrees, said spring clip will drives rotation of said decoration plate to realize automatic positioning after said rotation.

* * * * *